US008092167B2

(12) United States Patent
Wu

(10) Patent No.: US 8,092,167 B2
(45) Date of Patent: Jan. 10, 2012

(54) COOLING DEVICE FOR USE IN METAL HOT FORMATION

(75) Inventor: Yong-Gang Wu, Shenzhen (CN)

(73) Assignees: Fu Zhun Precision Industry (Shen Zhen) Co., Ltd., Shenzhen, Guangdong Province (CN); Foxconn Technolgoy Co., Ltd., Tu-Cheng, New Taipei (TW)

( * ) Notice: Subject to any disclaimer, the term of this patent is extended or adjusted under 35 U.S.C. 154(b) by 987 days.

(21) Appl. No.: 12/039,643

(22) Filed: Feb. 28, 2008

(65) Prior Publication Data

US 2009/0165523 A1 Jul. 2, 2009

(30) Foreign Application Priority Data

Dec. 29, 2007 (CN) ..... 2007 1 0125664

(51) Int. Cl.
*F04D 29/44* (2006.01)

(52) U.S. Cl. ..... 415/211.2

(58) Field of Classification Search ..... 415/211.2, 415/212.1; 72/342.1, 342.2
See application file for complete search history.

(56) References Cited

U.S. PATENT DOCUMENTS

| | | | | |
|---|---|---|---|---|
| 5,526,652 | A * | 6/1996 | Mantovan | 62/374 |
| 5,802,905 | A * | 9/1998 | Biswas et al. | 72/270 |
| 5,881,685 | A * | 3/1999 | Foss et al. | 123/41.49 |
| 6,928,816 | B2 * | 8/2005 | Leavesley | 60/602 |
| 7,257,976 | B1 * | 8/2007 | Fabris | 72/201 |

* cited by examiner

*Primary Examiner* — Edward Look
*Assistant Examiner* — Jesse Prager
(74) *Attorney, Agent, or Firm* — Altis Law Group, Inc.

(57) ABSTRACT

A guiding device (2) includes a base (21), a cover (23) and a sidewall (22) cooperatively defining an annular space therein and a passage therethrough. An air inlet (221) is defined in the sidewall communicating with the space for an airflow flowing into the space. A plurality of guiding plates (24) are arranged in the space around the passage. An air outlet (29) is defined between two neighboring guiding plates for the airflow flowing out the space into the passage. The airflow is distributed into a plurality of even streams by the guiding plates. An atomizer (4) is connected with the space via the air inlet. The atomizer produces a high-pressured water vapor which is taken by the airflow to cool an aluminum profile produced by an extrusions press (6) and moving through the passage.

13 Claims, 5 Drawing Sheets

COOLING DEVICE FOR USE IN METAL HOT FORMATION

BACKGROUND OF THE INVENTION

1. Field of the Invention

The present invention relates generally to a cooling device, and particularly to an air guiding device of the cooling device having an improved air outlet. The cooling device is used for cooling a metal profile after it is hot formation. Particularly the cooling device is used for cooling an aluminum profile after it is pressed through an aluminum extrusion press.

2. Description of Related Art

An aluminum profile after an extrusion forming of an extrusion press usually has a high temperature of about 500° C. The aluminum profile needs to be cooled. Usually two cooling fans are arranged at opposite sides of the aluminum profile to cool the aluminum profile. However, as the aluminum profile usually is irregular in shape, and thus the aluminum profile can not be cooled uniformly. After being cooled, part of the aluminum profile has a hardness which is not the same as the other part. Furthermore, the uneven cooling of the aluminum profile may cause the aluminum profile to have a deformation. Therefore, a cooling device which can uniformly cool the aluminum profile is needed.

Therefore, a cooling device is desired to overcome the above described shortcomings.

SUMMARY OF THE INVENTION

In accordance with the present embodiment, a cooling device includes a fan for generating a forced airflow and a guiding device. The guiding device includes a base, a cover and a sidewall cooperatively defining a space therein. The base defines an entrance, and the cover defines an exit corresponding to the entrance of the base. An air inlet is defined in the sidewall and communicates with the space for the forced airflow of the fan flowing into the space. A plurality of guiding plates are arranged in the space around the entrance of the base, and the guiding plates are spaced from each other. An air outlet is defined between two neighboring guiding plates for the airflow flowing out the space. When the airflow flows from the air inlet towards the air outlets, the airflow is distributed into a plurality of even streams by the guiding plates and each stream flows out the space through a corresponding air outlet. An atomizer is communicated with air inlet to provide high-pressured water vapor into the space. The vapor is mixed with the forced airflow to cool an aluminum profile extruded from an extrusion press and moving through the entrance and the exit of the guiding device.

Other advantages and novel features of the present invention will be drawn from the following detailed description of a preferred embodiment of the present invention with attached drawings, in which:

BRIEF DESCRIPTION OF THE DRAWINGS

Many aspects of the present cooling device can be better understood with reference to the following drawings. The components in the drawings are not necessarily drawn to scale, the emphasis instead being placed upon clearly illustrating the principles of the present cooling device. Moreover, in the drawings, like reference numerals designate corresponding parts throughout the several views.

DETAILED DESCRIPTION OF THE INVENTION

Figure 1:
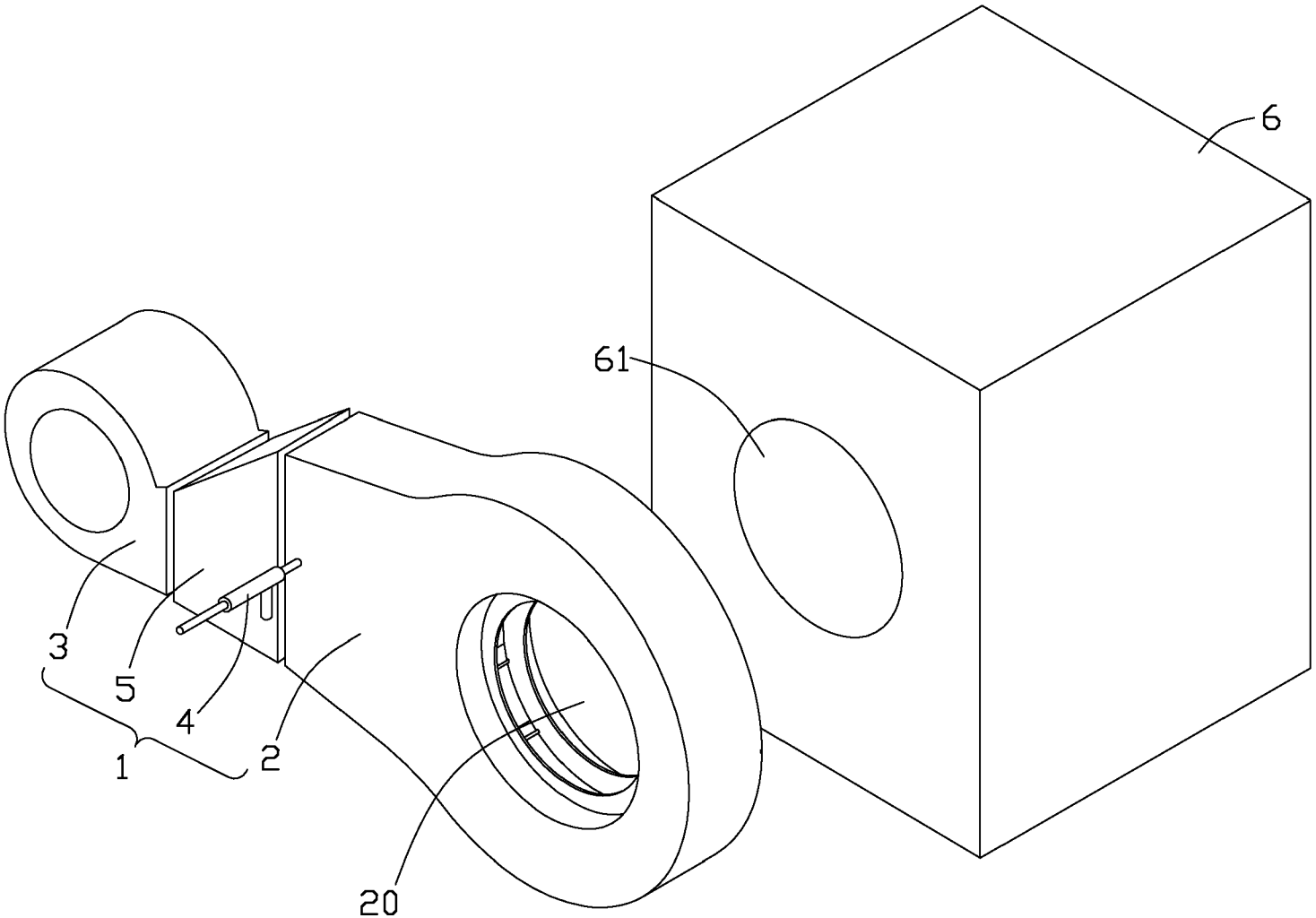
FIG. 1 is an isometric view of a cooling device according to a preferred embodiment of the present invention.

The detailed explanation of a cooling device 1 to the drawings attached hereto is given below. Referring to FIG. 1, the cooling device 1 is arranged at a side of an extrusion press 6 for cooling an aluminum profile (not shown) produced by the extrusion press 6. It is to be understood that the cooling device 1 can be used for cooling any profile which is hot formed and needs to be cooled after formation. An out port 61 is defined in the extrusion press 6 for discharging the aluminum profile.

The cooling device 1 includes a blower fan 3, a fan duct 5, a guiding device 2, and an atomizer 4. The blower fan 3 is configured for generating a forced airflow. The fan duct 5 interconnects the blower fan 3 and the guiding device 2. The fan duct 5 is a long tube, and thus the blower fan 3 can be arranged far from the extrusion press 6. Alternatively, the blower fan 3 can be connected to the guiding device 2 directly, without the fan duct 5.

Figure 2:
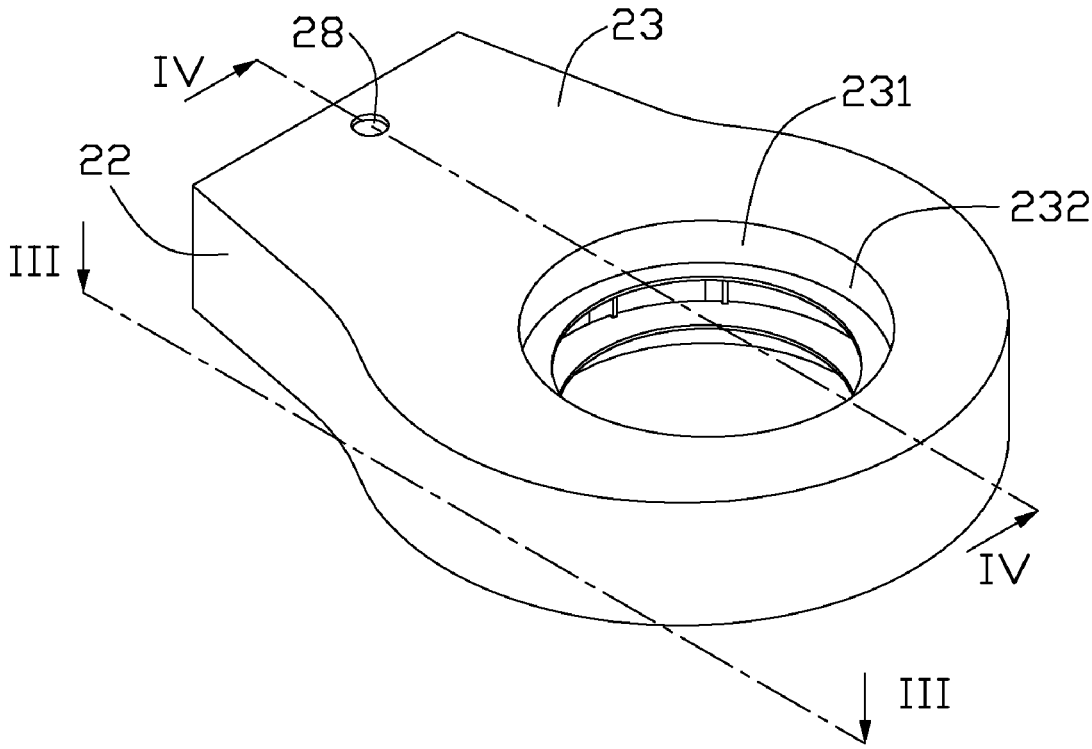
FIG. 2 shows a guiding device of the cooling device of FIG. 1 viewed from another aspect.
Figure 3:
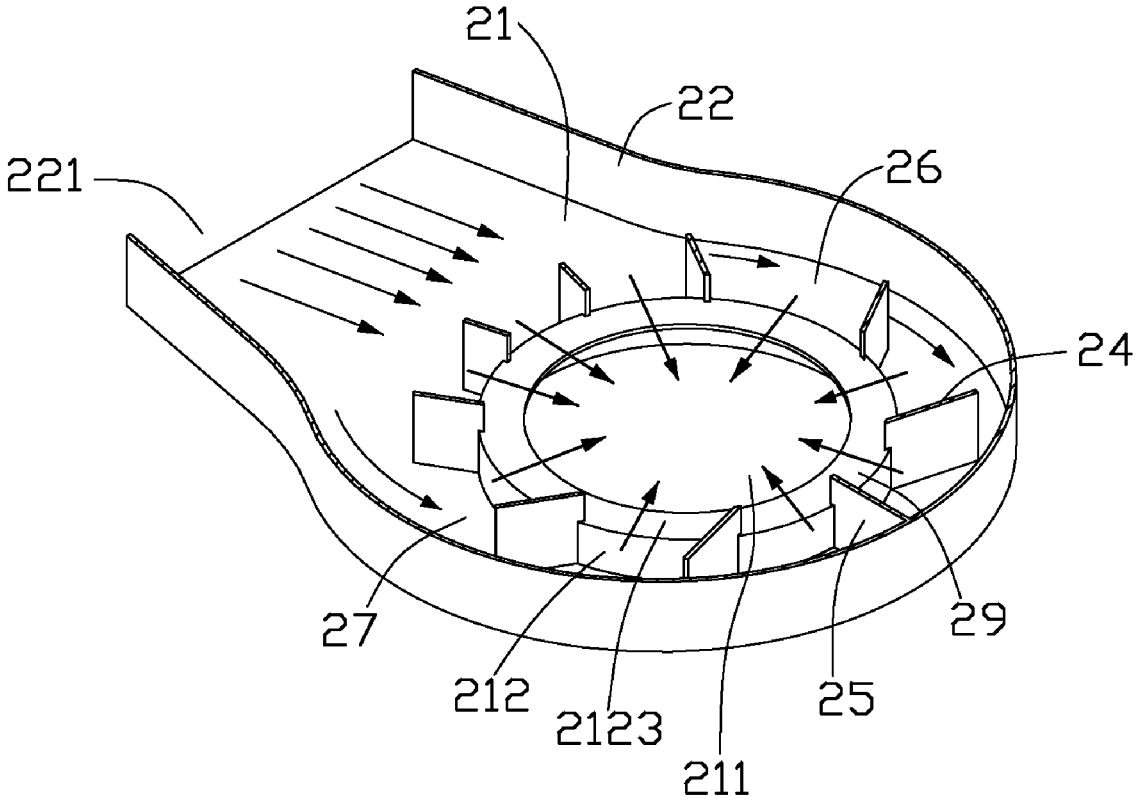
FIG. 3 is a cross-sectional view of the guiding device taken along line III-III of FIG. 2.
Figure 4:
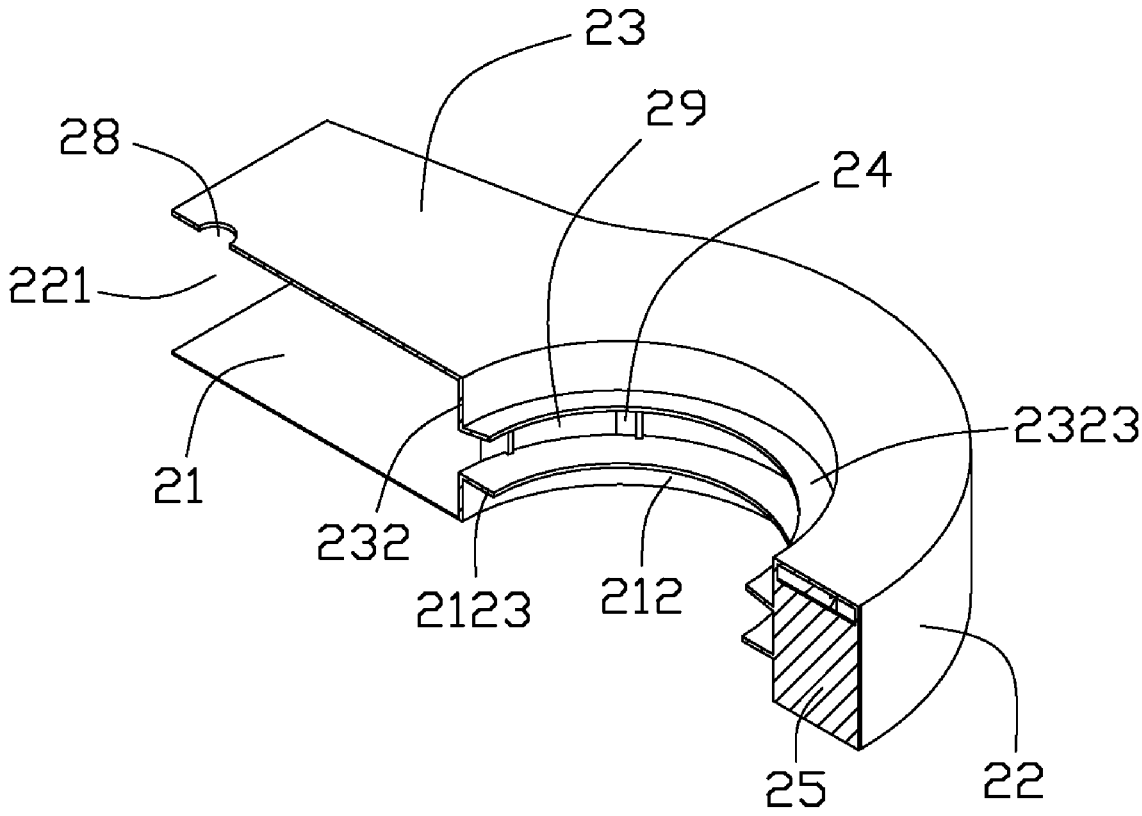
FIG. 4 is a cross-sectional view of the guiding device taken along line IV-IV of FIG. 2.

Referring to FIGS. 2 through 4, the guiding device 2 includes a base 21, a cover 23 and a sidewall 22 interconnecting outer peripheries of the base 21 and the cover 23. The base 21 and the cover 23 are approximately circular-shaped. An entrance 211 is defined in a central portion of the base 21, and an exit 231 is defined in a central portion of the cover 23 corresponding to the entrance 211 of the base 21. The entrance 211 and the exit 231 face to and align with the out port 61 of the extrusion press 6. A column-shaped passage 20 (as shown in FIG. 1) is thus defined between the entrance 211 and the exit 231 of the guiding device 2 for the aluminum profile to move therethrough after the aluminum profile is formed by the extrusion press 6. Thus, the aluminum profile can be cooled by the cooling device 1. An annular space (not labeled) is defined in the guiding device 2 communicating with the passage 20. An air inlet 221 is defined in the sidewall 22 of the guiding device 2 communicating with the annular space and the passage 20. The air inlet 221 of the guiding device 2 is substantially rectangle-shaped.

A lower cylinder 212 extends upwardly from an inner periphery of the base 21 defining the entrance 211 into the guiding device 2, and an upper cylinder 232 extends downwardly from an inner periphery of the cover 23 defining the exit 231 into the guiding device 2. Each cylinder 212, 232 has a height lower than that of a half of the sidewall 22, and thus a space is defined between the two cylinders 212, 232. A flange 2123, 2323 extends inwardly and upwardly from an inner end of the cylinder 212, 232. Thus each flange 2123, 2323 is aslant, and an inner side of each flange 2123, 2323 is higher than an outer side thereof. In other words, the inner side of each flange 2123, 2323 is near the exit 231 of the guiding device 2 than the outer side of each flange 2123, 2323.

A partition board 25 extends radially and outwardly from the lower cylinder 212 to the sidewall 22 of the guiding device 2. The partition board 25 is arranged distant from the air inlet 221 and separates the annular space into two equal parts, i.e., a front part 27 and a rear part 26, which are symmetrical to the partition board 25. A plurality of guiding plates 24 extend outwardly from the lower cylinder 212 into the two parts 27, 26 of the space. The guiding plates 24 are spaced from each other and are spaced from the partition board 25, and are arranged symmetrical to the partition board 25. The partition board 25 and the guiding plates 24 are higher than the lower cylinder 212 and thus extend into the space defined between the two cylinders 212, 232. An air outlet 29 is thus defined between two adjacent guiding plates 24 or between the partition board 25 and a neighboring guiding plate 24. The air outlets 29 communicate with the passage 20. An outer end of each guiding plate 24 is spaced from the sidewall 22 of the guiding device 2. Along a circumferential direction from the air inlet 221 to the partition board 25, a length of the guiding board 25 gradually increases, and an angle between the guiding plate 24 and the partition board 25 gradually decreases. Thus after the forced airflow of the blower fan 3 flows into the guiding device 2 through the air inlet 221, the airflow can be distributed over the plurality of air outlets 29 of the guiding device 2 evenly.

Figure 5:
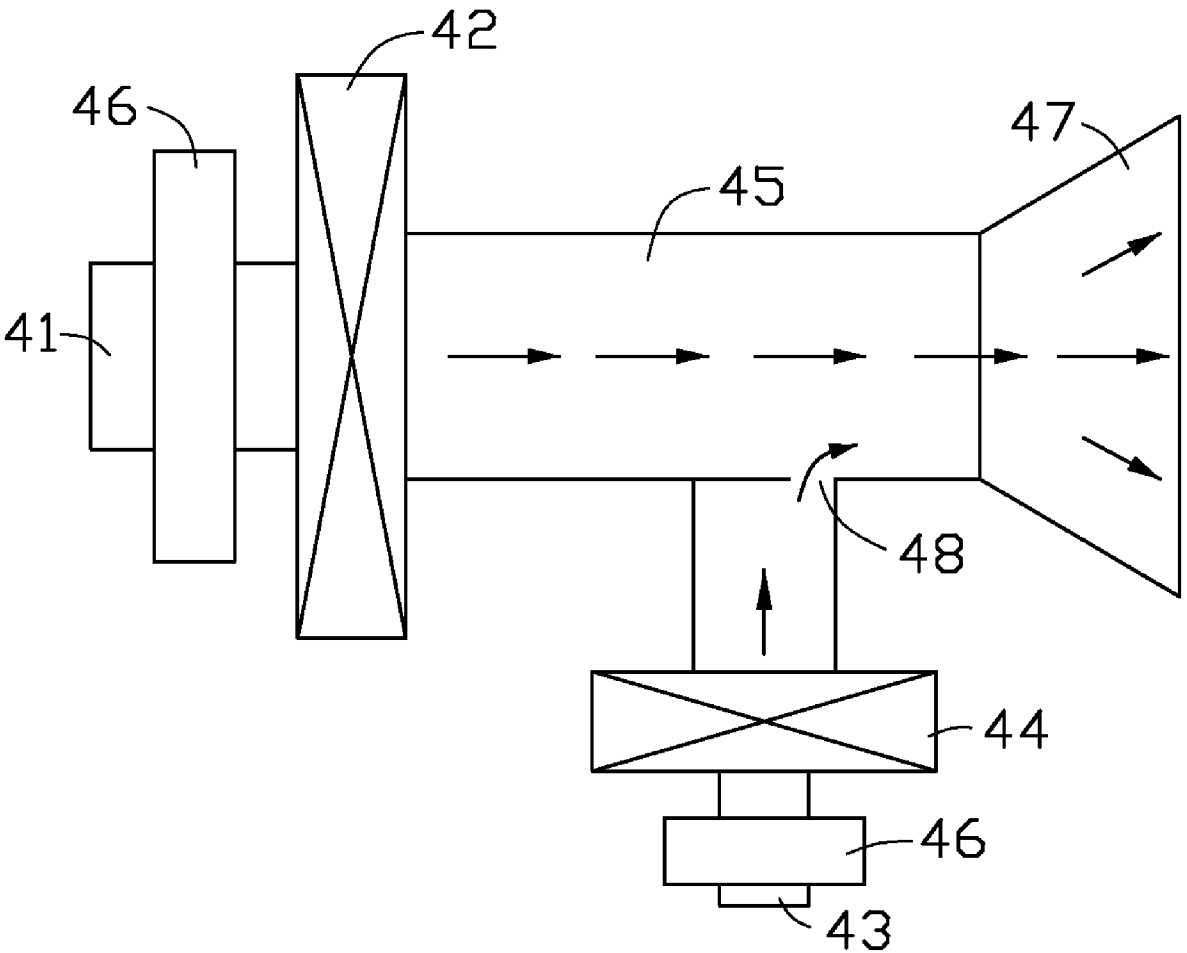
FIG. 5 shows a schematic diagram of an atomizer of the cooling device of FIG. 1.

Referring to FIG. 5, the atomizer 4 includes an air export 41 for providing high pressure air into the atomizer 4, a water export 43 for feeding water into the atomizer 4, an air control valve 42, a water control valve 44, a mixing chamber 45, and a nozzle 47. The air control valve 42 interconnects the air export 41 and the mixing chamber 45 to control flow of the high pressure air into the mixing chamber 45. The nozzle 47 is connected to an outlet of the mixing chamber 45. The mixing chamber 45 defines a through hole 48 therein; the through hole 48 communicates with the water export 43 through the water control valve 44 which is adapted for controlling flow of the water into the mixing chamber 45. When the air control valve 42 and the water control valve 44 are open, the high pressure air and the water flow into the mixing chamber 45. The water is separated into water vapor by the action of the high pressure air. The high-pressured water vapor then moves through the nozzle 47 into the air inlet 221 of the guiding device 2. An opening 28 (shown in FIGS. 2 and 4) is defined in the guiding device 2 communicating with the nozzle 47 of the atomizer 4. In this embodiment, the opening 28 is defined in the cover 23 and is located just over the air inlet 221 of the guiding device 2. Alternatively, the opening 28 can be defined in the base 21 of the guiding device 2.

During operation, the forced airflow mixes with the high-pressured water vapor in the air inlet 221 of the guiding device 2 and then flows towards the air outlets 29 of the guiding device 2. For the arrangement of the guiding plates 24 and the partition board 25, the mixture of the forced airflow and the high-pressured water vapor is distributed into a plurality of even streams. Each stream flows through a corresponding air outlet 29 to cool the aluminum profile. As the streams are approximately centrosymmetric to the aluminum profile, each part of the aluminum profile can be cooled at the same time. After being cooled, the aluminum profile has a uniform hardness. Furthermore, as the flanges 2123, 2323 are aslant toward the exit 231, after heat exchange of the airflow and the aluminum profile, the heated airflow is avoided to flow towards the entrance 211 of the base 21 of the guiding device 2 which is adjacent to the extrusion press 6. The heated airflow is guided by the flanges 2123, 2323 to leave the guiding device 2 via the exit 231 of the cover 23 of the guiding device 2. The disadvantage of the conventional cooling device that the heated air may flow back to the extrusion press is avoided by the present invention. The heat dissipation efficiency of the cooling device 1 in accordance with the present invention is thus improved.

In addition, as shown in FIG. 5, a first electromagnetic valve 46 is arranged between the air export 41 and the air control valve 42, and a second electromagnetic valve 46 is arranged between the water export 43 and the water control valve 44. A switching circuit (not shown) connects the first and second electromagnetic valves 46 and the extrusion press 6 together in series. When the switching circuit is on, the extrusion press 6 is activated to produce the aluminum profile. Synchronously, the first electromagnetic valve 46 and the second electromagnetic valve 46 are activated so that the air and water flow into the mixing chamber 45 at the same time to generate the high-pressured water vapor. The forced airflow of the blower fan 3 mixes with the high-pressured water vapor in the air inlet 221 of the guiding device 2 and flows through the air outlets 29 of the guiding device 2 to the passage 20 to cool the aluminum profile. When the extrusion press 6 is shut off by turning off the switching circuit, the first and second electromagnetic valves 46 are also shut off, whereby the atomizer 4 is stopped from producing the high-pressured water vapor. Thus the extrusion press 6 and the atomizer 4 are synchronous in action.

It can be understood that the above-described embodiment are intended to illustrate rather than limit the invention. Variations may be made to the embodiments and methods without departing from the spirit of the invention. Accordingly, it is appropriate that the appended claims be construed broadly and in a manner consistent with the scope of the invention.

What is claimed is:

1. A guiding device, comprising:

a base defining an entrance therein;

a cover defining an exit corresponding to the entrance of the base;

a sidewall interconnecting outer peripheries of the base and the cover, cooperatively the sidewall, the base and the cover defining a space therein, an air inlet being defined in the sidewall communicating with the space for an airflow flowing into the space;

a partition board arranged in the space and connecting to the sidewall, the partition board separating the space into two equal parts; and a plurality of guiding plates being arranged in the space around the entrance of the base, and the guiding plates being spaced from each other, an air outlet being defined between two neighboring guiding plates for the airflow flowing out the space, when the airflow flowing from the air inlet towards the air outlets, the airflow being distributed into a plurality of even streams and each stream flowing out the space through a corresponding air outlet.

2. The guiding device of claim 1, wherein along a circumferential direction from the air inlet to the partition board, a length of the guiding boards gradually increases, and an angle between the guiding plates and the partition board gradually decreases.

3. The guiding device of claim 1, wherein the guiding plates are arranged symmetric to the partition board and spaced from the partition board, the partition board and a corresponding neighboring guiding plate defining an air outlet therebetween.

4. The guiding device of claim 1, wherein a lower cylinder extends upwardly from an inner periphery of the base defining the entrance into the space, the guiding plates extending outwardly from the lower cylinder.

5. The guiding device of claim 4, wherein a flange extends aslant from an inner end of the lower cylinder, an outer side of the flange connected to the lower cylinder and located near the entrance than an inner side of the flange.

6. The guiding device of claim 1, wherein a height of the guiding plates is lower than that of the guiding device, and the guiding plates are arranged on the base and spaced from the cover.

7. The guiding device of claim 1, wherein an upper cylinder extends downwardly from an inner periphery of the cover defining the exit into the space, a flange extending aslant from an inner end of the upper cylinder, an outer side of the flange connected to the upper cylinder and located near the entrance than an inner side of the flange.

8. The guiding device of claim 1, wherein the space of the guiding device is substantially annular-shaped.

9. A cooling device, comprising:

a fan for generating a forced airflow; and a guiding device defining an annular space therein, the guiding device comprising:

a base defining an entrance therein;

a cover defining an exit corresponding to the entrance of the base;

a sidewall interconnecting outer peripheries of the base and the cover, an air inlet being defined in the sidewall and communicating with the space for the forced airflow of the fan flowing into the space;

a partition board arranged in the space and connecting to the sidewall, the partition board separating the space into two equal parts; and a plurality of guiding plates being arranged in the space around the entrance of the base, the guiding plates being spaced from each other, an air outlet being defined between two neighboring guiding plates for the airflow flowing out the space, when the airflow flowing from the air inlet towards the air outlets, the airflow being distributed into a plurality of even streams and each stream flowing out the space through a corresponding air outlet.

10. The cooling device of claim 9 further comprising an atomizer having a nozzle, the guiding device defining an opening adjacent to the air inlet, the opening intercommunicating the air inlet with the nozzle.

11. The cooling device of claim 9 further comprising a fan duct interconnecting the fan and the guiding device.

12. The cooling device of claim 9, wherein a lower cylinder extends upwardly from an inner periphery of the base defining the entry into the space, the guiding plates and the partition board extending outwardly from the lower cylinder, a flange extending aslant from an inner end of the lower cylinder, an outer side of the flange connected to the lower cylinder and located near the entrance than an inner side of the flange.

13. The cooling device of claim 12, wherein an upper cylinder extends downwardly from an inner periphery of the cover into the space, a second flange extending aslant from an inner end of the upper cylinder, an outer side of the second flange connected to the upper cylinder and located near the entrance than an inner side of the second flange, a height of each of the lower and upper cylinders being lower than a half of a height of the cooling device, a space being defined between the lower and upper cylinders.

* * * * *